United States Patent [19]

Elmore

[11] Patent Number: 4,867,845

[45] Date of Patent: Sep. 19, 1989

[54] VERTICAL STEAMING VESSEL

[75] Inventor: Carl L. Elmore, Glens Falls, N.Y.

[73] Assignee: Kamyr, Inc., Glens Falls, N.Y.

[21] Appl. No.: 206,811

[22] Filed: Jun. 15, 1988

[51] Int. Cl.[4] ..... D21C 3/26

[52] U.S. Cl. ..... 162/243; 162/250; 241/46 B

[58] Field of Search ..... 162/246, 250, 243; 222/146.4, 199; 241/46 B, 46.02, 46.17

[56] References Cited

U.S. PATENT DOCUMENTS

| | | | |
|---|---|---|---|
| 1,998,874 | 4/1935 | Koda | 162/246 X |
| 1,998,875 | 4/1935 | Koda | 162/246 X |
| 2,960,161 | 11/1960 | Richter . | |
| 3,035,962 | 5/1962 | Schinn | 162/250 X |
| 4,028,171 | 6/1977 | Richter | 162/246 X |
| 4,096,027 | 6/1978 | Sherman . | |
| 4,124,440 | 11/1978 | Sherman . | |
| 4,721,231 | 1/1988 | Richter . | |
| 4,746,404 | 5/1988 | Laakso . | |

FOREIGN PATENT DOCUMENTS

| | | |
|---|---|---|
| 1146788 | 5/1983 | Canada . |
| 1154622 | 10/1983 | Canada . |

*Primary Examiner*—Timothy V. Eley
*Attorney, Agent, or Firm*—Nixon & Vanderhye

[57] ABSTRACT

Wood chips, or like comminuted cellulosic fibrous material, are treated in a vertical presteaming vessel in the production of paper pulp. The vessel does not employ a vibrating discharge structure as is conventional, but rather utilizes as a discharge structure a plurality of rotating arms having depending blades, mounted at the bottom of the vessel, which force the wood chips toward a discharge opening in the vessel bottom. The steam is introduced into the vessel through a vertical tube concentric with the vessel, and surrounding a rotatable shaft which is connected to the arms of the discharge device. A truncated cone is provided at the bottom of the steam tube, making a slip connection with the tube, and overlies the discharge opening. The cone has maximum horizontal dimensions greater than those of the outlet, to cause the chips to move radially outwardly into contact with the discharge element. The vessel may be used in place of a chips bin in a conventional chips handling scheme, or may be utilized in place of a conventional horizontal screw steaming vessel.

18 Claims, 3 Drawing Sheets

VERTICAL STEAMING VESSEL

BACKGROUND AND SUMMARY OF THE INVENTION

In the chemical treatment of wood chips, or like comminuted cellulosic fibrous material, to produce paper pulp, typically some initial steaming of the chips is done in the chips bin, the chips are discharged from the chips bin (a vertical vessel) utilizing a vibratory discharge mechanism, and then the chips are treated in a horizontal steamer with a horizontal screw moving the chips through the steamer. There have been long recognized problems associated with such equipment, but in the past solutions to those problems which would still result in effective steaming of the chips, have not been forthcoming.

The problems associated with the prior art techniques include the following: (1) In a chips bin, the vibratory discharge mechanism has a tendency to result in "rat holing" of the chips, that is moving a slug of chips through the center of the vessel, while the chips at the wall do not move as effectively. That is, the chips at the walls of the vessel have a tendency to "hang up", while the chips in the center pass through the vessel. (2) The conventional horizontal steamer can only be operated at about 40–60% of capacity, and the horizontal screw is an expensive and high maintenance piece of equipment. Further, the horizontal screw may have a tendency to cause damage to some of the chips.

According to the invention, the problems associated with the conventional systems, such as described above, can be overcome. According to the present invention, a generally vertically disposed steaming vessel is provided, and can be operated about 90% full. The steaming vessel may be used in place of the chips bin, or in place of the horizontal steaming vessel, or both. The vertical vessel according to the invention does not include the undesirable vibratory discharge at the bottom thereof, but rather comprises a plurality of rotating arms with downwardly extending blades, the arms rotated by a concentric generally vertical shaft in the vessel. Steam is introduced into the vessel through a vertical conduit which is concentric with, and surrounds, the shaft. In this way, chips that are in contact with the steam conduit as they move vertically downwardly in the vessel are heated by transfer of heat from the conduit to the chips.

The steam is discharged from the bottom of the conduit and moves upwardly in the vessel to steam the chips. At the bottom the conduit preferably is in the form of a truncated cone, and a slip connection is provided between that cone and the conduit. The cone can either be made to rotate with the shaft and the blades, or the slip connection merely allows some relative movement should it be stressed by the contact with chips, or inadvertent contact with the rotating arms.

The truncated cone at the bottom of the steam tube preferably has maximum horizontal dimensions that are greater than the horizontal dimensions of the chips outlet in the bottom of the vessel. The cone also is vertically spaced from and overlies the chips outlet. In this way chips that are moving downwardly in the center of the vessel are deflected outwardly at the bottom of the vessel, so that they do not have a tendency to merely "rat hole" through the center of the vessel. The rotating arms with scraper blades comprises the only structure for discharging the chips from the vessel, no vibratory structure being necessary.

According to the invention there is also provided a method of steaming comminuted cellulosic fibrous material, such as wood chips. The method comprises the steps of: (a) Feeding material into the top of the vessel, to establish a column of material in the vessel which moves downwardly therein. (b) Supplying steam to the interior of the vessel so that it passes substantially the height of the vessel, and then moves outwardly and upwardly adjacent the bottom of the vessel. (c) Rotating the discharge element at the bottom of the vessel to cause steamed material to be discharged through the discharge opening in the bottom of the vessel. And, (d) preventing material flowing directly from above the discharge opening into the discharge opening by deflecting the material radially outwardly just above the discharge opening, so that it moves into contact with the rotating discharge element and is moved toward the discharge opening thereby.

It is the primary object of the present invention to provide for the simplified, yet effective, steaming of chips prior to the passage of the chips to a pre-impregnation vessel or a digester. This and other objects of the invention will become clear from an inspection of the detailed description of the invention, and from the appended claims.

DETAILED DESCRIPTION OF THE DRAWINGS

Figure 1:
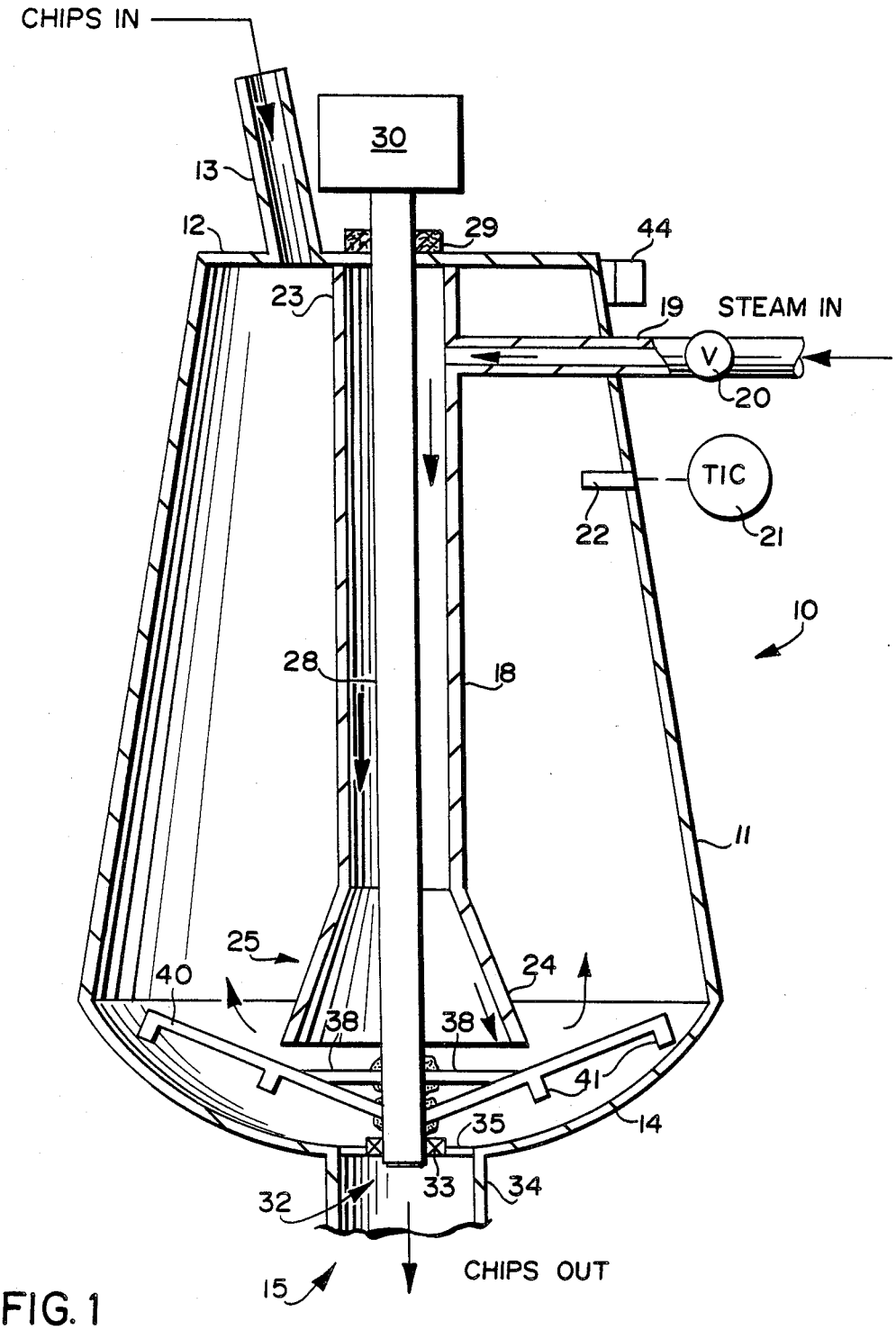
FIG. 1 is a side, schematic, cross-sectional view of an exemplary vertical steaming vessel according to the invention.

A steaming apparatus according to the present invention is shown generally at reference numeral 10 in FIG. 1. The apparatus is designed to steam wood chips, or like comminuted cellulosic fibrous material, at or near atmospheric pressure, or under pressurized conditions (e.g. 18 psig). When the apparatus 10 is used in place of a conventional chips bin it would typically steam at or near atmospheric pressure, whereas when it is used in place of a conventional horizontal steamer with a rotatable screw, it would operate at about 18 psig, or like pressurized conditions.

The apparatus 10 includes a generally vertically disposed vessel 11 that flares slightly outwardly from the top to the bottom thereof (as illustrated in FIG. 1), and has a top 12 with means defining a chips inlet 13 in the top, off center of a vertical line through the vessel. The vessel 11 also includes a bottom 14 with portions of the bottom 14 comprising means defining a discharge opening 15 in the bottom, the discharge opening 15 being concentric with the vessel 11.

Chips in the vessel 11 are provided with steam through a generally vertical steam conduit 18, which comprises a metal tube that is generally concentric with the vessel 11. A steam supply conduit 19 is in communication with the tube 18 near the top thereof, and a valve 20 valves the supply of steam through the inlet 19 in the conduit 18. The valve 20 is controlled by a temperature controller 21, which is operatively connected to a temperature sensor 22 within the vessel 11 in the top half thereof. The tube 18 has a top 23, which is preferably welded or otherwise stationarily attached to the top 12 of the vessel 11, and an open bottom portion 24. As illustrated in FIG. 1, the open bottom portion 24 preferably is in the form of a truncated cone having its minimum dimension attached to the conduit 18, and its maximum dimension overlying, but vertically spaced from, the discharge opening 15. The maximum horizontal dimensions of the cone 24 are greater than those of the discharge opening 15 so that chips will flow outwardly at the bottom of the vessel, rather than merely passing directly into the opening 15 from the center of the vessel. Preferably, the truncated cone bottom portion 24 is not stationary with respect to the tube 18, but rather some movement therebetween is possible. This is preferably provided by a conventional slip connection 25 between the tube 18 and the portion 24.

Preferably the tube 18 is solid-walled, although under some circumstances it may have openings along its length to allow some steam out at different levels in the vessel 11.

Also disposed in the vessel 11 is a generally vertical shaft 28 which is essentially concentric with the vessel 11, and is surrounded by the steam conduit 18. The shaft is mounted by packing gland 29 at the top thereof, and is driven by a variable speed geared motor 30 mounted atop the vessel 11. The bottom end 31 of the shaft 30—in the FIG. 1 embodiment—is mounted for rotation by bearings 32, disposed within outlet opening 15. In this way, the shaft is rotated about a generally vertical axis.

Figure 2:
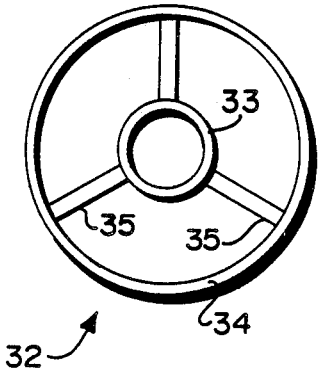
FIG. 2 is a detail view of the chips outlet of the apparatus of FIG. 1.

The bearing means 32 for mounting the bottom 31 of the shaft 28 may take the form illustrated in FIG. 2, in which a bearing collar 33 is supported by an exterior ring 34 and arms 35, the structure comprising what is commonly referred to as a "spider". In this way, although the shaft is journaled within the opening 15, material may flow quite freely through the opening 15 since the majority of the space between the elements 33, 34, and 35 is open space.

The shaft 28 is provided for the purpose of powering an outlet device (discharge element, material moving means) at the bottom of the vessel 11. Preferably the outlet device comprises a plurality of arms 40 with depending blade elements (e.g. plows or rakes) 41. The arms 40 may be connected to the bottom portion 24, which in turn is connected by a plurality of arm segments 38 to the shaft 28, or the arm segments 38 themselves may connect to the arms 40, with the bottom portion 24 being vertically spaced therefrom (as illustrated in FIG. 1). The arms 38, 40, with the blades 41, rotate with the shaft 28 under the influence of the motor 30, and cause chips material within the vessel 10 that is radially spaced from the outlet 15, adjacent the bottom 14, to pass to the outlet 15.

The apparatus 10 may also include other conventional structures desirable for effective operation as a the steaming vessel, such as a chips level device 44, or the like.

Figure 3:
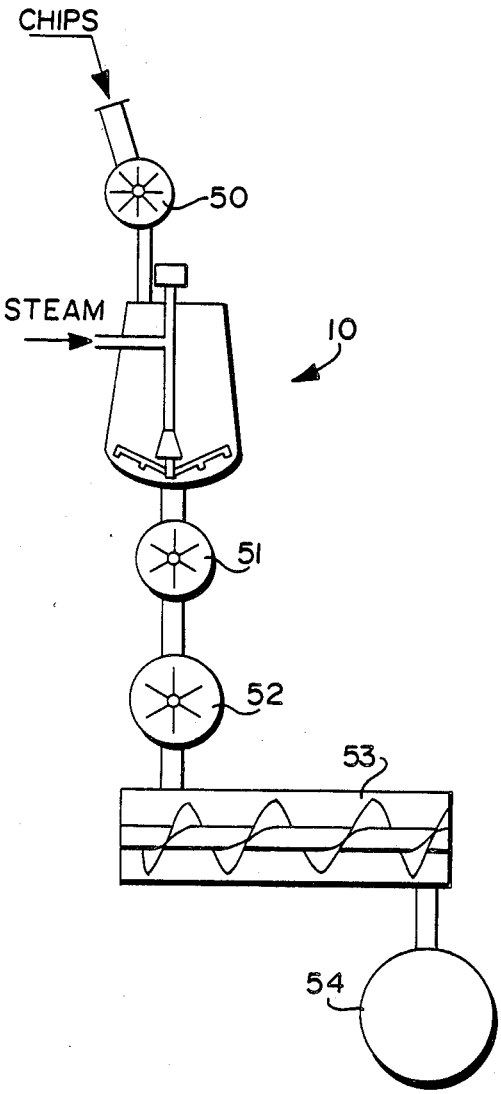
FIGS. 3 and 4 are schematics illustrating two alternate constructions of apparatus useful for steaming chips.
Figure 4:
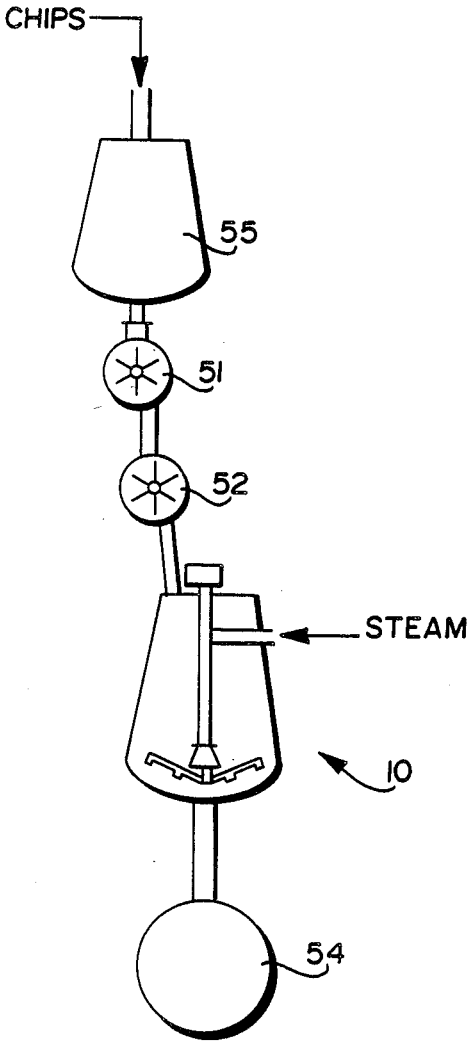

Various manners in which the apparatus 10 may be utilized in chips steaming systems are illustrated in FIGS. 3 and 4. In FIG. 3, the apparatus 10 merely takes the place of a conventional chips bin with steaming, such as shown in U.S. Pat. No. 4,124,440. The inlet 13 is connected to a conventional chip meter/airlock 50, while the outlet 15 is connected to a second conventional chip meter 51. Chip meter 51 is connected to a conventional low pressure feeder 52, which in turn is connected to a conventional horizontal steaming vessel 53, with a rotatable screw. The horizontal vessel 53 is connected to a conventional high pressure feeder 54, which in turn is connected to the inlet to a pre-impregnation vessel or a digester (not shown).

In the FIG. 4 embodiment, the apparatus 10 is shown in place of the conventional horizontal steaming vessel 53, and a conventional chips bin 55 which either may, or may not, have atmospheric presteaming (as shown in U.S. Pat. No. 4,124,440) may be provided. The discharge from the chips bin is connected to a chips meter 51, which in turn is connected to a low pressure feeder 52, in turn connected to the inlet 13 to the apparatus 10. The discharge opening 15 from the apparatus 10 is then connected to the conventional high pressure feeder, which in turn is connected to a pre-impregnation vessel or digester (not shown).

In the FIG. 3 embodiment, the apparatus 10 operates at or near atmospheric pressure, while in the FIG. 4 embodiment, the apparatus 10 is pressurized (e.g. about 18 psig, the standard pressure for horizontal steaming vessels).

Figure 6:
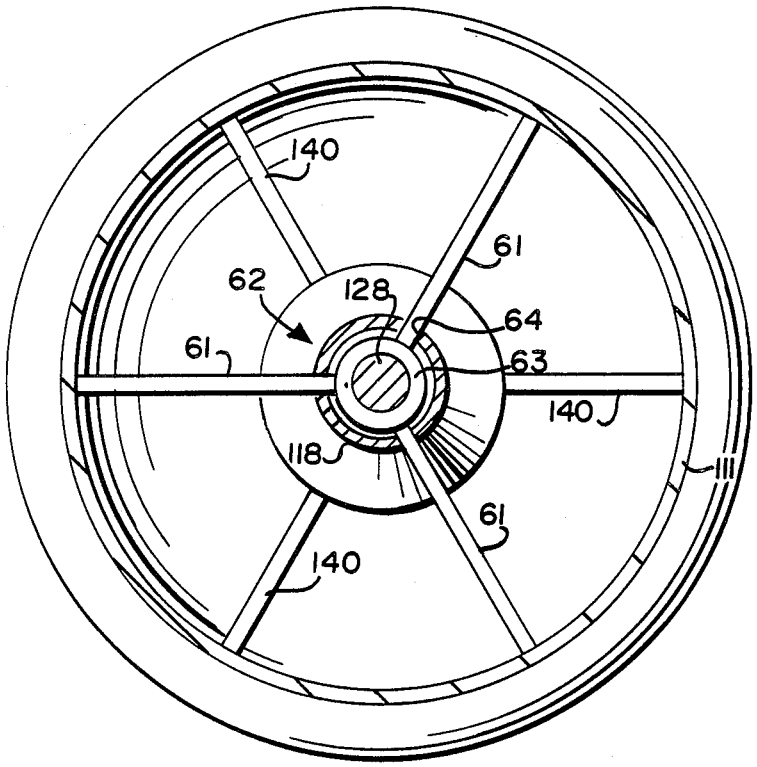
FIG. 6 is a cross-sectional view taken at the mid-section of the vessel of FIG. 5.
Figure 5:
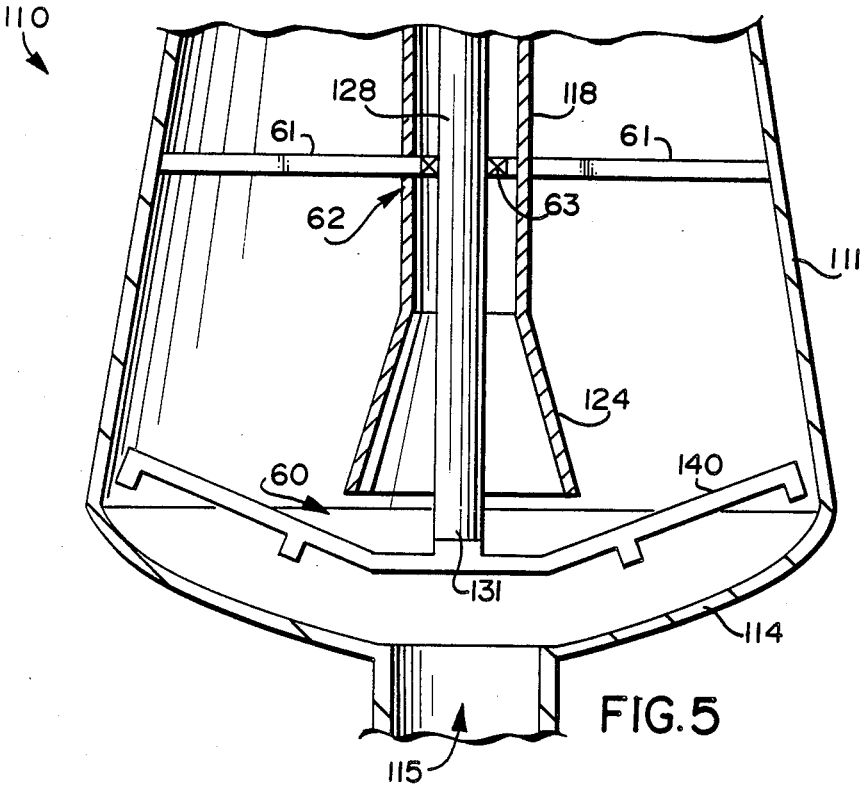
FIG. 5 is a partial side, cross-sectional, schematic view of a second embodiment of a vessel according to the invention.

The embodiment of FIGS. 5 and 6 is similar to that of FIGS. 1 and 2, except that the chips outlet from the vessel is completely unobstructed. In this embodiment structures corresponding to those of the FIGS. 1 and 2 embodiment are illustrated by the same reference numeral only preceded by a "1".

In the FIGS. 5 and 6 apparatus 110, the vessel 111 includes the chips outlet 115 in the bottom 114 thereof, the concentric steam tube 118 with truncated cone bottom portion 124, and the rotatable shaft 128 connected at its bottom end 131 thereof to the rotating arms 140. Steam flows outwardly from the conduit 118 at the bottom 60 of the truncated cone 124. In this embodiment, the shaft 128 is supported (in addition to a packing gland at the top thereof) at a point spaced from the chips outlet 115 so that the chips outlet 115 is totally unobstructed. In this embodiment, a plurality of radially extending arms 61 support the tube 118 at a mid-portion thereof, and extending inwardly from the tube 118 are arms 64 which are preferably continuations of the arms 61. The arms 64 support the interior bearings 63 which engages the shaft 128 and support it for rotation, the structures 63, 64 providing a spider arrangement and being shown generally by the reference numeral 62 in both FIGS. 5 and 6. Steam may readily flow in the open spaces between the elements 63, 64, and the supports 61 have small enough dimensions that they do not provide significant "hang up" of the chips in the vessel 111.

Utilizing the apparatus of FIGS. 1 through 6, a method of steaming comminuted cellulosic fibrous material is provided. The method comprises the steps of (with particular reference to the FIG. 1 embodiment): (a) Feeding material into the top of the vessel 11, to establish a column of material in the vessel which moves downwardly therein. (b) Supplying steam to the interior of the vessel (through 18, 19) so that it passes substantially the height of the vessel, and then moves outwardly and upwardly adjacent the bottom of the vessel (out 24). (c) Rotating the discharge element 40, 41 at the bottom of the vessel (with motor 30) to cause steamed material to be discharged through the discharge opening 15 in the bottom 14 of the vessel 11. And, (d) preventing material flowing directly from above the discharge opening 15 into the discharge opening by deflecting the material radially outwardly (by cone 24) just above the discharge opening 15, so that it moves into contact with the rotating discharge element 40, 41 and is moved toward the discharge opening 15 thereby. The vessel 11 may be operated about 90% full, no vibratory discharge device is necessary, and the apparatus 10 can be used to replace a conventional horizontal steamer (53).

It will thus be seen that according to the present invention an apparatus and method have been provided for the effective steaming of chips while eliminating many of the drawbacks associated with prior art apparatus, such as the expense of horizontal steaming vessels, or the drawbacks associated with vibratory discharges from chips bins with presteaming. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A steaming apparatus for steaming comminuted cellulosic fibrous material, comprising:

a generally vertically oriented vessel having a top and a closed bottom;

means defining a material inlet in said top and means defining a centrally located material outlet in said closed bottom;

a shaft extending generally vertically in said vessel, and generally concentric therewith;

means for mounting said shaft for rotation about a generally vertical axis;

a generally vertical conduit, generally concentric with said shaft, for conducting steam;

a steam inlet to said conduit near the top thereof;

an outlet from said conduit at the bottom thereof;

said conduit outlet disposed above said material outlet; and material moving means mounted to said shaft at the closed bottom of said vessel for rotation by said shaft to move material from the closed bottom of said vessel across the width thereof to said material outlet.

2. Apparatus as recited in claim 1 wherein said conduit outlet comprises a shroud having horizontal dimensions greater than the horizontal dimensions of said material outlet, and overlies and is vertically spaced from said material outlet.

3. Apparatus as recited in claim 2 wherein said shroud is a truncated cone.

4. Apparatus as recited in claim 3 wherein said material moving means comprises a plurality of arms with blades extending downwardly therefrom.

5. A steaming apparatus for steaming comminuted cellulosic fibrous material, comprising:

a generally vertically oriented vessel having a top and a bottom;

means defining a material inlet in said top and means defining a material outlet in said bottom;

a shaft extending generally vertically in said vessel, and generally concentric therewith;

means for mounting said shaft for rotation about a generally vertical axis;

a generally vertical conduit, generally concentric with said shaft, for conducting steam;

a steam inlet to said conduit near the top thereof;

an outlet from said conduit at the bottom thereof;

said conduit outlet disposed above said material outlet and comprising a shroud having horizontal dimensions greater than the horizontal dimensions of said material outlet, and overlying and being vertically spaced from said material outlet; and material moving means mounted to said shaft at the bottom of said vessel for rotation by said shaft to move material from the bottom of said vessel across the width thereof to said material outlet.

6. Apparatus as recited in claim 5 wherein said conduit is stationary with respect to said vessel along the majority of the length thereof.

7. Apparatus as recited in claim 6 wherein said shroud is movable with respect to the rest of said conduit.

8. Apparatus as recited in claim 7 wherein said conduit has openings along its length.

9. Apparatus as recited in claim 7 further comprising a slip connection between said shroud and said conduit.

10. Apparatus as recited in claim 5 wherein said conduit is stationary with respect to said vessel along the entire length thereof, including said shroud.

11. A generally vertical vessel having a top and a bottom, and generally symmetrical about a vertical axis, and having a vertical center line, and comprising:

means defining an opening in the top thereof offset from said center line;

means defining an opening in the bottom thereof generally concentric with said center line;

a generally vertical shaft disposed in said vessel, generally concentric therewith;

means for mounting said shaft for rotation about a vertical axis generally coincident with said vertical center line;

a generally vertical tube stationary with respect to said vessel and disposed therein, surrounding said shaft along the majority of the length thereof;

a truncated cone shaped open bottom portion of said tube vertically spaced from and overlying said vessel bottom opening; and a plurality of arms with blades connected to said shaft just above said bottom, and for rotation with said shaft.

12. A vessel as recited in claim 11 wherein said shroud has maximum horizontal dimensions greater than the horizontal dimensions of said opening in the bottom of said vessel, and overlies and is vertically spaced from said bottom opening, said shroud being above said bottom opening and operatively cooperating therewith.

13. A steaming apparatus for steaming comminuted cellulosic fibrous material, comprising:

a generally vertically oriented vessel having a top and a bottom;

means defining a material inlet in said top and means defining a material outlet in said bottom;

a shaft extending generally vertically in said vessel, and generally concentric therewith;

means for mounting said shaft for rotation about a generally vertical axis;

a generally vertical conduit, generally concentric with said shaft, for conducting steam;

a steam inlet to said conduit near the top thereof;

an outlet from said conduit at the bottom thereof;

said conduit outlet disposed above said material outlet;

said material outlet being unobstructed, said shaft, conduit and material moving means terminating short of said material outlet and not extending into it; and material moving means mounted to said shaft at the bottom of said vessel for rotation by said shaft to move material from the bottom of said vessel across the width thereof to said material outlet.

14. Apparatus as recited in claim 13 wherein said conduit outlet comprises a truncated cone shroud having maximum horizontal dimensions greater than the horizontal dimensions of said material outlet, and overlying and vertically spaced from said material outlet.

15. A generally vertical vessel having a top and a bottom, and generally symmetrical about a vertical axis, and having a vertical center line, and comprising:

means defining an opening in the top thereof offset from said center line;

means defining an opening in the bottom thereof generally concentric with said center line;

a generally vertical shaft disposed in said vessel, generally concentric therewith;

means for mounting said shaft for rotation about a vertical axis generally coincident with said vertical center line;

a generally vertical tube stationary with respect to said vessel and disposed therein, surrounding said shaft;

a truncated cone shaped open bottom portion of said tube vertically spaced from and overlying said vessel bottom opening;

a slip connection between said truncated cone bottom portion and said tube; and a plurality of arms with blades connected to said shaft just above said bottom, and for rotation with said shaft.

16. A steaming apparatus for steaming comminuted cellulosic fibrous material, comprising:

a generally vertically oriented vessel having a top and a bottom;

means defining a material inlet in said top and means defining a material outlet in said bottom;

a shaft extending generally vertically in said vessel, and generally concentric therewith;

means for mounting said shaft for rotation about a generally vertical axis, comprising a bearing at the lower end of said shaft, and a spider mounting said bearing substantially in the center of said material outlet;

a generally vertical conduit, generally concentric with said shaft, for conducting steam;

a steam inlet to said conduit near the top thereof;

an outlet from said conduit at the bottom thereof;

said conduit outlet disposed above said material outlet; and material moving means mounted to said shaft at the bottom of said vessel for rotation by said shaft to move material from the bottom of said vessel across the width thereof to said material outlet.

17. A steaming apparatus for steaming comminuted cellulosic fibrous material, comprising:

a generally vertically oriented vessel having a top and a bottom;

means defining a material inlet in said top and means defining a material outlet in said bottom;

a shaft extending generally vertically in said vessel, and generally concentric therewith;

means for mounting said shaft for rotation about a generally vertical axis;

a generally vertical conduit, generally concentric with said shaft, for conducting steam;

a steam inlet to said conduit near the top thereof;

an outlet from said conduit at the bottom thereof;

said conduit outlet disposed above said material outlet; and material moving means mounted to said shaft at the bottom of said vessel for rotation by said shaft to move material from the bottom of said vessel across the width thereof to said material outlet; said steaming apparatus being devoid of a vibrating discharge mechanism, said material moving means consisting essentially of a plurality of arms connected to said shaft, with blades extending downwardly therefrom.

18. Apparatus as recited in claim 17 wherein said conduit outlet comprises a truncated cone shroud having maximum horizontal dimensions greater than the horizontal dimensions of said material outlet, and overlying and vertically spaced from said material outlet.

* * * * *